US011335261B2

(12) United States Patent
Liu et al.

(10) Patent No.: US 11,335,261 B2
(45) Date of Patent: May 17, 2022

(54) DISPLAY PANEL AND DRIVING METHOD THEREOF, AND DISPLAY APPARATUS

(71) Applicant: BOE Technology Group Co., Ltd., Beijing (CN)

(72) Inventors: Weixing Liu, Beijing (CN); Tieshi Wang, Beijing (CN); Wei Qin, Beijing (CN); Chunfang Zhang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/202,560

(22) Filed: Mar. 16, 2021

(65) Prior Publication Data

US 2022/0036820 A1 Feb. 3, 2022

(30) Foreign Application Priority Data

Jul. 28, 2020 (CN) ..... 202010737812.X

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01); *G09G 2300/0852* (2013.01); *G09G 2330/021* (2013.01)

(58) Field of Classification Search
CPC ..... G09G 3/3233; G09G 2300/0426; G09G 2300/0819; G09G 2300/0852; G09G 2330/021
See application file for complete search history.

(56) References Cited

U.S. PATENT DOCUMENTS

2021/0295785 A1* 9/2021 Huang ..... G09G 3/3233
2021/0296371 A1* 9/2021 Yamazaki ..... H03K 19/00315

* cited by examiner

*Primary Examiner* — Stacy Khoo
(74) *Attorney, Agent, or Firm* — ArentFox Schiff LLP; Michael Fainberg

(57) ABSTRACT

A display panel and a driving method thereof, and a display apparatus are provided. In the present disclosure, external compensation circuits electrically connected to pixel circuits are added. The external compensation circuits are configured to adjust anode voltages of light emitting devices to cause the anode voltages of the light emitting devices to be consistent with voltages of data voltage ends.

18 Claims, 6 Drawing Sheets

DISPLAY PANEL AND DRIVING METHOD THEREOF, AND DISPLAY APPARATUS

CROSS-REFERENCE TO RELATED APPLICATION

This application is based on and claims priority under 35 U.S.C 119 to Chinese Patent Application No. 202010737812.X, filed on Jul. 28, 2020, in the China National Intellectual Property Administration. The entire disclosure of the above application is incorporated herein by reference.

FIELD

The present disclosure relates to the technical field of displaying, and more particularly relates to a display panel and a driving method thereof, and a display apparatus.

BACKGROUND

Electroluminescent display panels are one of the hotspots in the field of flat panel display research. The electroluminescent display panels include an organic light emitting diode (OLED) display panel, a micro LED display panel and a mini LED display panel, etc. Compared with a liquid crystal display (LCD), an electroluminescent display panel display has the advantages of low energy consumption, low production cost, self-luminescence, wide visual angle, high response speed, and the like. At present, in the display fields of mobile phones, tablet computers, digital cameras, and the like, the electroluminescent displays have begun to replace traditional LCDs.

Unlike an LCD that uses a stable voltage to control the brightness, the electroluminescent display is current-driven and requires a stable current to control its light emission. An active matrix organic light emitting diode (AMOLED) display is taken as an example. A basic function of an AMOLED display panel is to refresh display signals at the beginning of a frame period, and use a storage capacitor Cst to maintain a stable signal voltage in the frame period and apply the signal voltage to a control end of a driving device, for example, between a gate and a source of a driving thin film transistor (DTFT), so that the driving device can stably output a pixel driving current in the frame period.

SUMMARY

Some embodiments of the present disclosure provide a display panel, including a display region and a non-display region surrounding the display region. The display region includes a plurality of pixel regions in an array distribution; each of the pixel regions includes a pixel circuit and a light emitting device; and the non-display region includes external compensation circuits. Each column of pixel circuits is electrically connected to a same external compensation circuit, and different columns of pixel circuits are electrically connected to different external compensation circuits;

the pixel circuit includes a driving transistor electrically connected to the light emitting device;

a first positive input end of each external compensation circuit is electrically connected to anodes of all corresponding light emitting devices; a first negative input end of each external compensation circuit is electrically connected to a data voltage end; and a first output end of each external compensation circuit is electrically connected to gates of all corresponding driving transistors;

the external compensation circuit is configured to adjust anode voltages of the light emitting devices to cause the anode voltages of the light emitting devices to be consistent with a voltage of the data voltage end and to cause the driving transistors to work in a linear region.

Alternatively, in the above-mentioned display panel provided in embodiments of the present disclosure, the pixel circuit further includes: a first switch transistor, a second switch transistor, a third switch transistor and a first capacitor;

both a gate of the first switch transistor and a gate of the second switch transistor are electrically connected to a first scanning control end; a first electrode of the first switch transistor is electrically connected to the first output end; a second electrode of the first switch transistor is electrically connected to the gate of the driving transistor;

a first electrode of the second switch transistor is electrically connected to the first positive input end, and a second electrode of the second switch transistor is electrically connected to the anode of the light emitting device;

a first electrode of the driving transistor is electrically connected to a first electrode of the third switch transistor, and a second electrode of the driving transistor is electrically connected to the anode of the light emitting device;

a gate of the third switch transistor is electrically connected to a second scanning control end, and a second electrode of the third switch transistor is electrically connected to a first power end;

the first capacitor is electrically connected between the gate of the driving transistor and the first power end;

a cathode of the light emitting device is grounded.

Alternatively, in the above-mentioned display panel provided in embodiments of the present disclosure, the external compensation circuit includes: a comparison circuit and a feedback circuit;

the comparison circuit is configured to output a working voltage according to the anode voltage of the light emitting device and the voltage of the data voltage end;

the feedback circuit is configured to control, according to the working voltage, the first capacitor to be charged and discharged to cause the anode voltage of the light emitting device to be consistent with the voltage of the data voltage end.

Alternatively, in the above-mentioned display panel provided in embodiments of the present disclosure, the comparison circuit includes a comparator; the comparator has the first positive input end, the first negative input end and a second output end; and the second output end is electrically connected to the feedback circuit.

Alternatively, in the above-mentioned display panel provided in the embodiments of the present disclosure, the feedback circuit includes: an amplifier, a first resistor, a second resistor and a second capacitor;

the amplifier has a second positive input end, a second negative input end and the first output end; the second positive input end is electrically connected to a first end of the first resistor; a second end of the first resistor is grounded;

the second negative input end is electrically connected to a first end of the second resistor; a second end of the second resistor is electrically connected to the second output end;

the second capacitor is electrically connected between the second negative input end and the first output end.

Alternatively, in the above-mentioned display panel provided in embodiments of the present disclosure, a product of resistance times capacitance, (RC) between the first output end and the gate of the driving transistor is identical to a product of RC between the first positive input end and the anode of the light emitting device.

Alternatively, in the above-mentioned display panel provided in embodiments of the present disclosure, the comparison circuit further includes a third resistor; and the third resistor is electrically connected between the first negative input end and the first positive input end.

Alternatively, in the above-mentioned display panel provided in embodiments of the present disclosure, the driving transistors and all the switch transistors are P-type transistors or N-type transistors.

Correspondingly, some embodiments of the present disclosure further provide a display apparatus, including the foregoing display panel provided in some embodiments of the present disclosure.

Correspondingly, some embodiments of the present disclosure further provide a driving method of the foregoing display panel provided in the embodiments of the present disclosure, including:

at a reset and compensation stage, the driving transistors work in the linear region, and each external compensation circuit adjusts the anode voltages of the light emitting devices to cause anode voltages of the light emitting devices to be consistent with a voltage of the data voltage end;

at a light emitting stage, the pixel circuits drive the light emitting devices to emit light.

Alternatively, in the driving method provided in embodiments of the present disclosure, at the light emitting stage, in response to that a light emitting gray scale of the light emitting device is a preset gray scale, increasing the voltage of the data voltage end to increase the anode voltage of the light emitting device and reducing a duty ratio of the third switch transistor.

DETAILED DESCRIPTION OF THE EMBODIMENTS

In order to make the objectives, technical solutions and advantages of the present disclosure clearer, specific implementation modes of a display panel and a driving method thereof, and a display apparatus provided in the embodiments of the present disclosure are described in detail below in combination with accompanying drawings.

Figure 1:
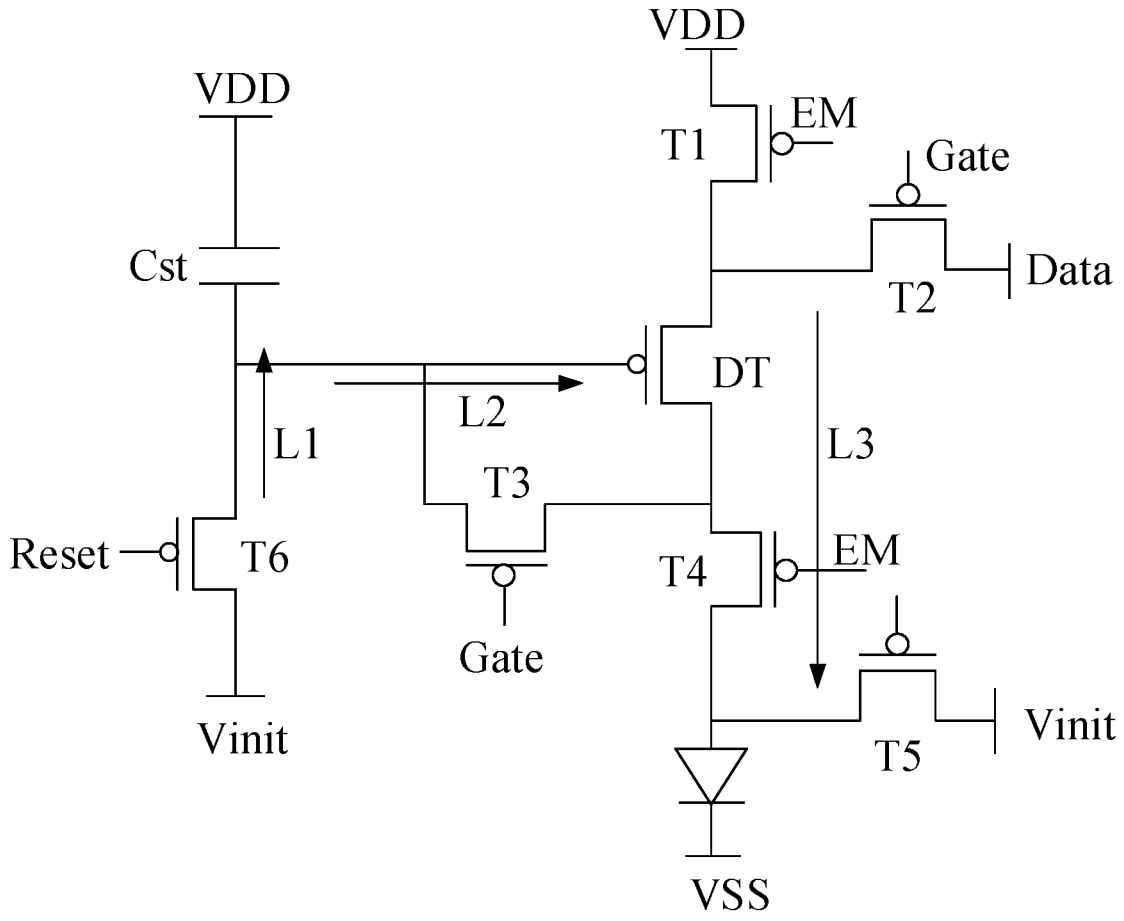
FIG. 1 is a schematic diagram of a circuit structure of a pixel circuit in the related art.

For an OLED display panel, pixel circuits are generally used to drive light emitting devices to emit light. At present, a mostly used pixel circuit mainly includes a 7T1C structure. As shown in FIG. 1, the 7T1C-structured pixel circuit can compensate a threshold voltage of a driving transistor DT in the pixel circuit to solve the problem of drift of the threshold voltage caused by a manufacturing process. However, it is crucial to reduce the power consumption of the display panel when the display panel emits light. The power consumption of the display panel is reflected in the pixel circuit, and mainly includes dynamic power consumption and static power consumption. The dynamic power consumption and the static power consumption of the pixel circuit are introduced by taking FIG. 1 as an example.

The dynamic power consumption refers to power consumption caused by a circuit in which the current direction changes, such as arrows L1 and L2 in FIG. 1, and the static power consumption refers to power consumption on a circuit in which the current direction does not change, such as an arrow L3 in FIG. 1.

A calculation formula of the dynamic power consumption ($P_{dynamic}$) corresponding to the arrows L1 and L2 in FIG. 1 is as follows:

$$P_{dynamic}=\Sigma CV^2 f$$

wherein the dynamic power consumption ($P_{dynamic}$) is related to a capacitance C of each node, a voltage fluctuation range V of each node, and a refresh frame rate f of an image. The capacitance C includes a stray capacitance of a data line, a storage capacitance Cst, a Gate capacitance of the driving transistor DT, a Gate capacitance of a switch transistor, and a stray capacitance on a switch circuit in FIG. 1.

Therefore, the dynamic power consumption can be reduced by reducing the quantity of switch transistors in the pixel circuit.

The static power consumption in the pixel circuit is the current direction part indicated by the arrow L3 in FIG. 1. This power consumption exists all the time at the light emitting stage. The static power consumption has no relation to the refresh rate, but is related to a resistance divided voltage of the driving transistor DT. If the resistance divided voltage of the driving transistor DT is reduced, the static power consumption ratio is reduced. At this time, the value of the first power end VDD may be correspondingly reduced to reduce the static power consumption.

Since the static power consumption is composed of heat radiated by the driving transistor DT and light emitted by the light emitting device, a primary way to reduce the static power consumption is to reduce the static power consumption consumed by the driving transistor DT.

Figure 2:
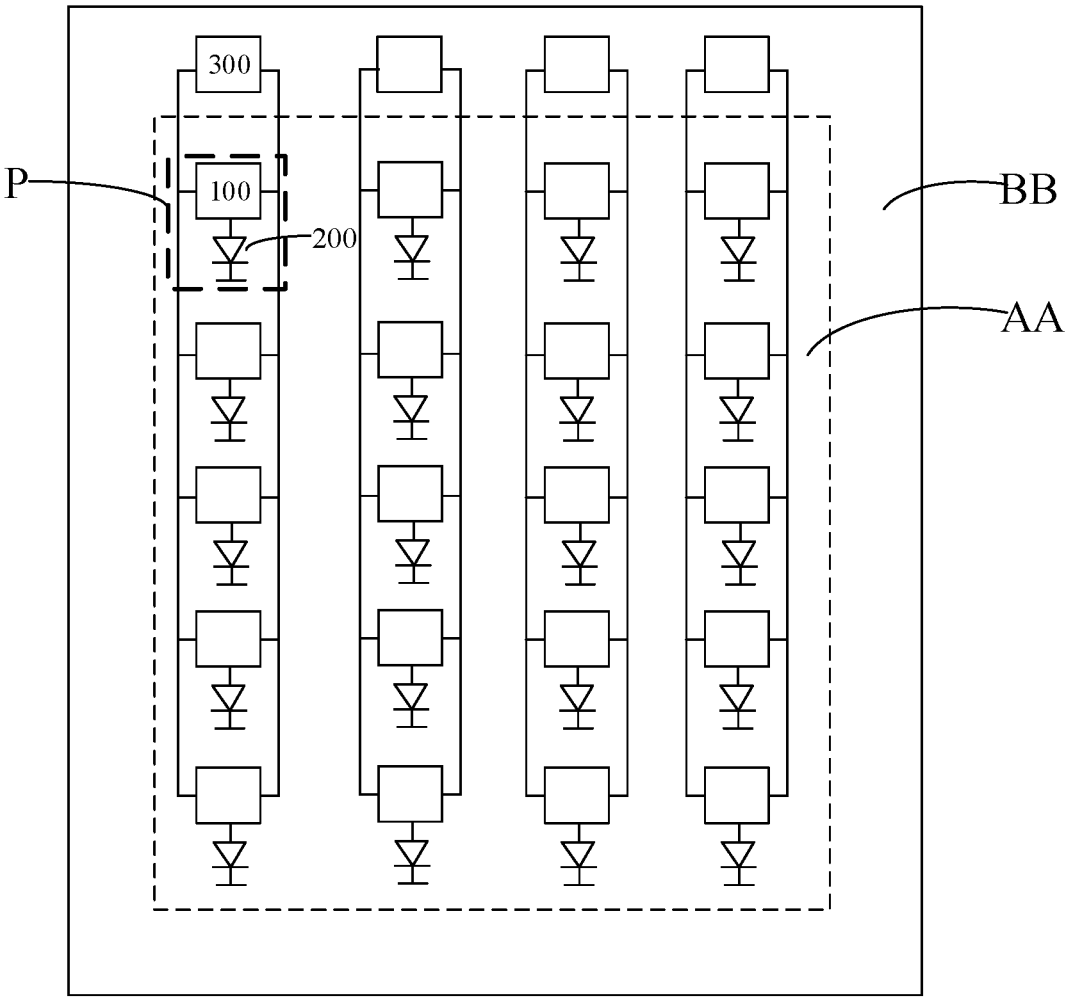
FIG. 2 is a structural schematic diagram of a display panel provided in the embodiments of the present disclosure.

In view of this, some embodiments of the present disclosure provide a display panel, as shown in FIG. 2, including a display region AA and a non-display region BB surrounding the display region AA. The display region AA includes a plurality of pixel regions P in an array distribution; the pixel regions P include pixel circuits 100 and light emitting devices 200; and the non-display region BB includes external compensation circuits 300. Each column of pixel circuits 100 is electrically connected to the same external compensation circuit 300, and different columns of pixel circuits 100 are electrically connected to different external compensation circuits 300.

Figure 3:
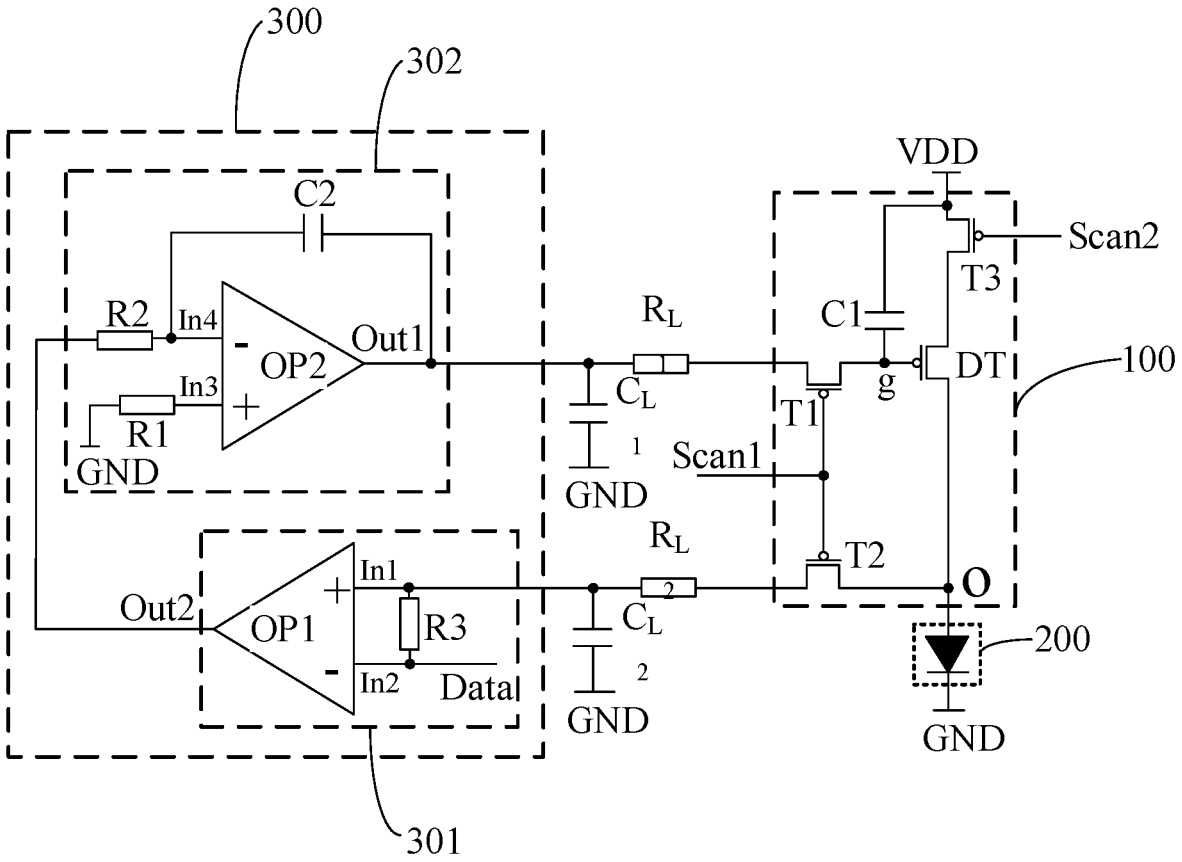
FIG. 3 is a schematic diagram of a structure of a pixel circuit and an external compensation circuit corresponding to FIG. 2.

As shown in FIG. 3, the pixel circuit 100 includes a driving transistor DT electrically connected to the light emitting device 200.

A first positive input end of the external compensation circuit 300 is electrically connected to anodes of all the light emitting devices 200; a first negative input end of the external compensation circuit 300 is electrically connected to a data voltage end Data; and a first output end of the external compensation circuit 300 is electrically connected to gates of all the driving transistors DT.

The external compensation circuit 300 is configured to adjust an anode voltage of the light emitting device 200 to cause the anode voltage of the light emitting device 200 to be consistent with a voltage of the data voltage end Data and to cause the driving transistor DT to work in a linear region.

In the above-mentioned display panel provided in some embodiments of the present disclosure, the external compensation circuits 300 electrically connected to the pixel circuits 100 are added. Since the external compensation circuits 300 are configured to adjust the anode voltages of the light emitting devices 200 to cause the anode voltages of the light emitting devices 200 to be consistent with the voltages of the data voltage ends Data, threshold voltages of the driving transistors DT do not need to be compensated. Therefore, the driving transistors DT can work in the linear region. When the light emitting devices 200 emit light with the same brightness, divided voltages of the driving transistors DT in the present disclosure are greatly reduced, thus reducing the power consumption of the pixel circuits 100.

In some embodiments of the present disclosure, as shown in FIG. 3, the display panel is generally configured to drive the light emitting device 200 to emit light. The light emitting device 200 is generally an organic light emitting diode (OLED), and can realize light emission under the action of a current when the driving transistor DT is in a linear state. In addition, the light emitting device 200 generally has a threshold voltage, and emits light when a voltage at two ends of the light emitting device 200 is greater than or equal to the threshold voltage.

In some embodiments of the present disclosure, as shown in FIG. 3, the pixel circuit 100 further includes: a first switch transistor T1, a second switch transistor T2, a third switch transistor T3 and a first capacitor C1;

both a gate of the first switch transistor T1 and a gate of the second switch transistor T2 are electrically connected to a first scanning control end Scan1; a first electrode of the first switch transistor T1 is electrically connected to the first output end Out1; a second electrode of the first switch transistor T1 is electrically connected to the gate of the driving transistor DT;

a first electrode of the second switch transistor T2 is electrically connected to the first positive input end In1, and a second electrode of the second switch transistor T2 is electrically connected to the anode of the light emitting device 200;

a first electrode of the driving transistor DT is electrically connected to a first electrode of the third switch transistor T3, and a second electrode of the driving transistor DT is electrically connected to the anode of the light emitting device 200;

a gate of the third switch transistor T3 is electrically connected to a second scanning control end Scan2, and a second electrode of the third switch transistor T3 is electrically connected to a first power end VDD;

the first capacitor C1 is electrically connected between the gate of the driving transistor DT and the first power end VDD;

a cathode of the light emitting device 200 is grounded (GND).

As shown in FIG. 3, since the pixel circuit 100 provided in embodiments of the present disclosure only includes one driving transistor DT and three switch transistors, the dynamic power consumption of the pixel circuit can be reduced in comparison with a 7T1C-structured pixel circuit in the related art.

In some embodiments of the present disclosure, as shown in FIG. 3, the voltage of the first power end VDD is generally a high-level voltage.

In some embodiments of the present disclosure, as shown in FIG. 3, the external compensation circuit 300 includes: a comparison circuit 301 and a feedback circuit 302;

the comparison circuit 301 is configured to output a working voltage according to the anode voltage of the light emitting device 200 and the voltage of the data voltage end Data;

the feedback circuit 302 is configured to control, according to the working voltage, the first capacitor C1 to be charged and discharged to cause the anode voltage of the light emitting device 200 to be consistent with the voltage of the data voltage end Data.

In some embodiments of the present disclosure, as shown in FIG. 3, the comparison circuit 301 includes a comparator OP1. The comparator OP1 has a first positive input end In1, a first negative input end In2 and a second output end Out2, and the second output end Out2 is electrically connected to the feedback circuit 302.

As shown in FIG. 3, a working principle of the comparator OP1 is: when the anode voltage (a voltage at the point o) of the light emitting device 200 is less than the voltage of the data voltage end Data, the second output end Out2 of the comparator OP1 outputs a low-level working voltage; and when the anode voltage (a voltage at the point o) of the light emitting device 200 is greater than the voltage of the data voltage end Data, the second output end Out2 of the comparator OP1 outputs a high-level working voltage.

In some embodiments of the present disclosure, as shown in FIG. 3, the feedback circuit 302 includes: an amplifier OP2, a first resistor R1, a second resistor R2 and a second capacitor C2;

the amplifier OP2 has a second positive input end In3, a second negative input end In4 and a first output end Out1; the second positive input end In3 is electrically connected to a first end of the first resistor R1; and a second end of the first resistor R1 is grounded (GND);

the second negative input end In4 is electrically connected to a first end of the second resistor R2; a second end of the second resistor R2 is electrically connected to the second output end Out2;

the second capacitor C2 is electrically connected between the second negative input end In4 and the first output end Out1.

Figure 4:
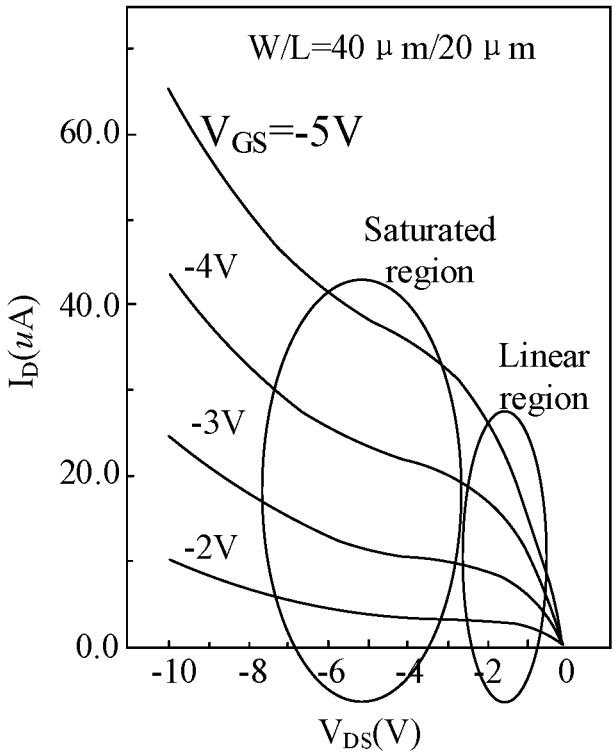
FIG. 4 is a schematic diagram of voltages of a driving transistor that works in a linear region and a saturated region.

As shown in FIG. 3, a working principle of the amplifier OP2 is: it can be obtained by means of the virtual short and virtual open properties of an ideal operational amplifier:

(vi−0)/R2=dQ/dt=C*d(0−vo)/dt, wherein vi refers to a voltage output by the second output end Out2; 0 refers to a voltage of the second negative input end; vo refers to a voltage output by the first output end Out1; as a result, it is obtained that vo=−1/(R2*C)∫vdt. Therefore, the amplifier OP2 can slowly charge the first capacitor C1 untill the anode voltage (the voltage at the point o) of the light emitting device 200 is consistent with the voltage of the data voltage end Data. The external compensation circuits 300 provided in embodiments of the present disclosure can directly adjust the anode voltages of the light emitting devices 200, so that the threshold voltages of the driving transistors DT do not need to be compensated, and the driving transistors DT can work in the linear region. In the related art, for the 7T1C-structured pixel circuits, the threshold voltages need to be compensated, and then the driving transistors in the related art need to work in a saturated region. As shown in FIG. 4, a schematic diagram of divided voltages of a driving transistor that works in the linear region and the saturated region is illustrated. It can be seen that the driving transistor has a lower divided voltage when working in the linear region, so that the embodiments of the present disclosure can reduce the power consumption of the pixel circuits.

Alternatively, a calculation formula of the static power consumption ($P_{static}$) of the pixel circuits is:

$$P_{static}=\Sigma\ (V_{DD}-V_{SS})\times I_{OLED}$$

for example: In a conventional pixel circuit, when an L255 gray scale is displayed, a voltage difference between VDD and VSS (electrically connected to the cathode) is 6.7 V. The driving transistor has a divided voltage of about 3.8 V when working in the saturated region, and the driving transistor has a greatly reduced divided voltage when working in the linear region. The voltage difference between VDD and VSS is 4.5 V, which can achieve required brightness. Compared with the power consumption of the conventional pixel circuit, the power consumption can be reduced by about 33%. Therefore, embodiments of the present disclosure can reduce the power consumption of the pixel circuits.

Independence of a current that flows into the light emitting device in the display panel provided in some embodiments of the present disclosure from the threshold voltage Vth of the driving transistor is simulated below.

Figure 5:
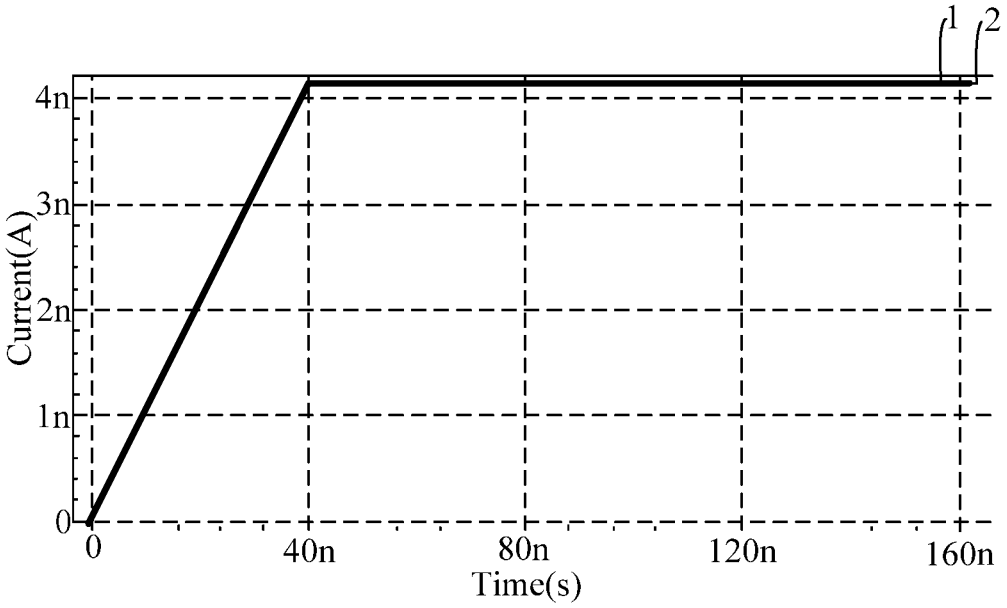
FIG. 5 is a schematic diagram of a simulation structure of independence of a current that flows into an anode from a threshold voltage of a driving transistor.

As shown in FIG. 5, Curve 1 is a current-time curve chart when Vth=−1.1 V, and Curve 2 is a current-time curve chart when Vth=−1.2 V. It can be seen that the current that flows through the light emitting device does not change when Vth changes. Therefore, normal driving can be realized, and non-uniformity and drift of Vth cannot affect the uniformity of the display brightness. Therefore, the driving transistor of the present disclosure can work in the linear region to reduce the static power consumption. Furthermore, the threshold voltage of the driving transistor does not need to be compensated in the present disclosure, so that a smaller number of switch transistors can be used, and the dynamic power consumption can be then reduced.

In some embodiments of the present disclosure, as shown in FIG. 3, a product of resistance times capacitance (RC) between the first output end Out1 and the gate of the driving transistor DT and a product of RC between the first positive input end In1 and the anode of the light emitting device 200 are the same. Alternatively, $R_{L1}$, $C_{L1}$, $R_{L2}$, and $C_{L2}$ are illustrated on the circuit of FIG. 3. A product of $R_{L1}$ and $C_{L1}$ denotes a load on a circuit between the first output end Out1 and the gate of the driving transistor DT, and a product of $R_{L2}$ and $C_{L2}$ denotes a load on a circuit between the first positive input end In1 and the anode of the light emitting device 200. Or, FIG. 3 does not illustrate $R_{L1}$, $C_{L1}$, $R_{L2}$, and $C_{L2}$, either, and $R_{L1}$, $C_{L1}$, $R_{L2}$, and $C_{L2}$ only refer to loads on circuits. The products of RC on the two circuits are set to be the same to ensure that the charge and discharge rate of the first capacitor C1 and a rate of reading the anode voltage (the voltage at the point o) of the light emitting device 200 are the same to ensure that the first capacitor C1 is stably charged and discharged.

During implementation, the display panel has a Blank stage during displaying, so that the first negative input end of the comparator is in a floating state at this stage to cause noise. In order to reduce the noise of the first negative input end, in the above-mentioned display panel provided in the embodiments of the present disclosure, as shown in FIG. 3, the comparison circuit 301 may further include a third resistor R3. The third resistor is electrically connected between the first negative input end In2 and the first positive input end In1. Of course, during implementation, the third resistor R3 may not be disposed, either.

During implementation, in the above-mentioned display panel provided in the embodiments of the present disclosure, as shown in FIG. 3, the driving transistor DT and all the switch transistors (T1-T3) are P-type transistors. Of course, all of them may also be N-type transistors. As such, only one type of transistor needs to be prepared, so that process steps of masking, photoetching and the like can be reduced, the technological flow can be simplified, and the production cost can be reduced.

During implementation, in the above-mentioned display panel provided by the embodiments of the present disclosure, the P-type transistors are turned on under the action of a low level and turned off under the action of a high level. The N-type transistors are turned on under the action of a high level and turned off under the action of a low level.

It should be noted that in the foregoing display panel provided in the embodiments of the present disclosure, the driving transistors and the switch transistors may be thin film transistors (TFTs), or metal oxide semiconductor (MOS) field-effect transistors. They are not limited here.

During implementation, the functions of the first electrodes and the second electrodes of these switch transistors may be interchanged according to different types of switch transistors and different signals of signal ends. The first electrodes may be sources, and the second electrodes may be drains, or the first electrodes may be drains, and the second electrodes may be sources. No specific distinguishing is made here.

Figure 6:
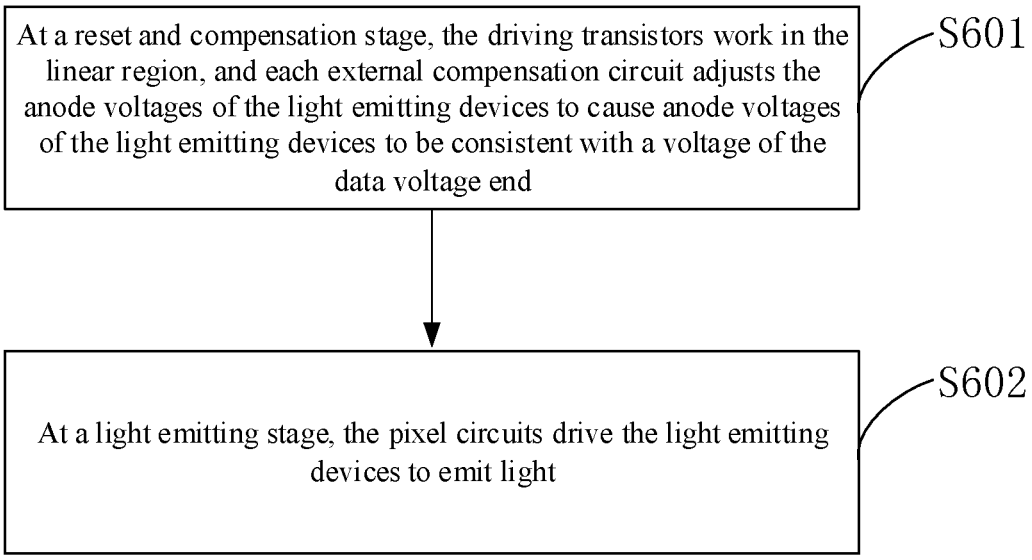
FIG. 6 is a flow diagram of a driving method of a display panel provided in the embodiments of the present disclosure.

Based on the same inventive concept, some embodiments of the present disclosure further provide a driving method of the foregoing display panel provided in embodiments of the present disclosure, as shown in FIG. 6, including:

S601, at a reset and compensation stage, the driving transistors work in the linear region, and each external compensation circuit adjusts the anode voltages of the light emitting devices to cause anode voltages of the light emitting devices to be consistent with a voltage of the data voltage end;

S602, at a light emitting stage, the pixel circuits drive the light emitting devices to emit light.

According to the driving method of the above-mentioned display panel provided in embodiments of the present disclosure, since the external compensation circuits adjust the anode voltages of the light emitting devices to cause the anode voltages of the light emitting devices to be consistent with the voltages of the data voltage ends, the threshold voltages of the driving transistors do not need to be compensated. Therefore, the driving transistors can work in the linear region. When the light emitting devices emit light with the same brightness, divided voltages of the driving transistors in the present disclosure are greatly reduced, thus reducing the power consumption of the pixel circuits.

During implementation, since an OLED product displays 256 gray scales in total from 0 to 255 from low to high during displaying, the anode voltage of the light emitting device is higher at a larger gray scale. When a lower gray scale is displayed, the corresponding anode voltage is lower, the divided voltage of the driving transistor is higher, and the voltage loss is greater, resulting in increased power consumption. In order to reduce the power consumption of the pixel circuit during the displaying of the lower gray scales, in the above-mentioned driving method provided in the embodiments of the present disclosure, at the light emitting stage, when it is determined that a light emitting gray scale of the light emitting device is a preset gray scale, the preset gray scale may be a lower gray scale, such as a gray scale of 0 to 10; and at this time, the voltage of the data voltage end can be increased. The anode voltage of the light emitting device is consistent with the voltage of the data voltage end at the light emitting stage, so that the anode voltage of the light emitting device can be increased, and the divided voltage of the driving transistor is reduced accordingly. The brightness at a low gray scale is lower, it is necessary to reduce the duty ratio of the third switch transistor, that is, to reduce the turn-on duration of the third transistor in order to achieve displaying with the same brightness. Therefore, during displaying of a lower gray scale, in order to reduce the static power consumption of the pixel circuit, the displaying with the same brightness can be realized by means of increasing the voltage of the data voltage end and reducing the duty ratio of the third switch transistor.

The working principle of the display panel is described in detail below by taking the condition that the driving transistor and all the switch transistors in the pixel circuit in the above-mentioned display panel are all P-type transistors as an example.

Figure 7:
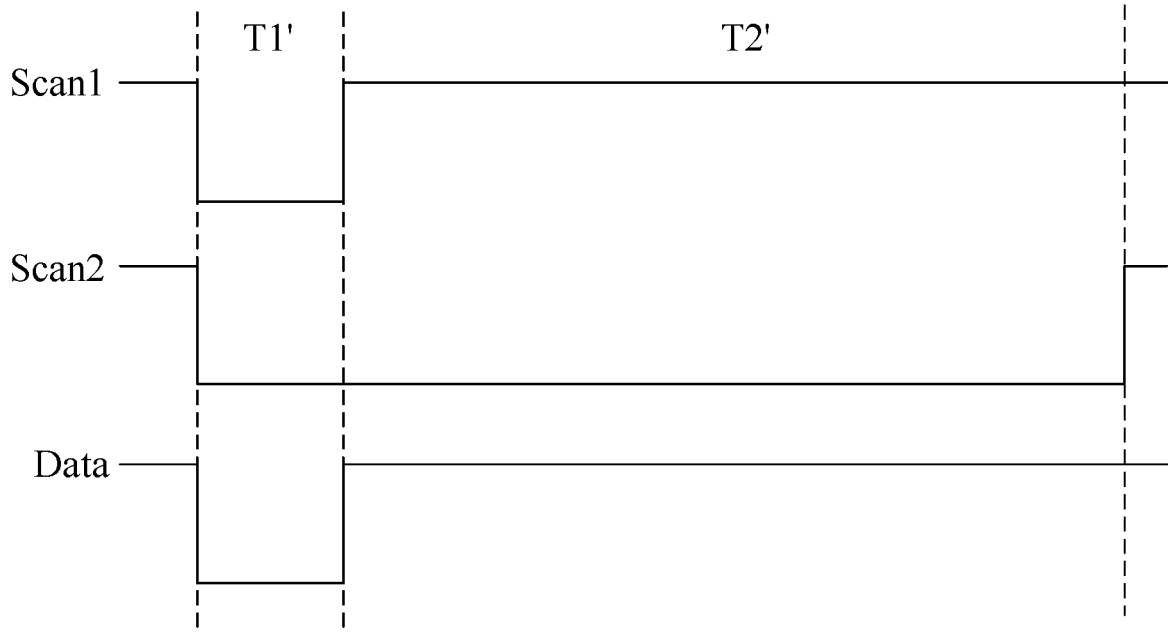
FIG. 7 is a schematic diagram I of a working time sequence of the display panel corresponding to FIG. 3.
Figure 8:
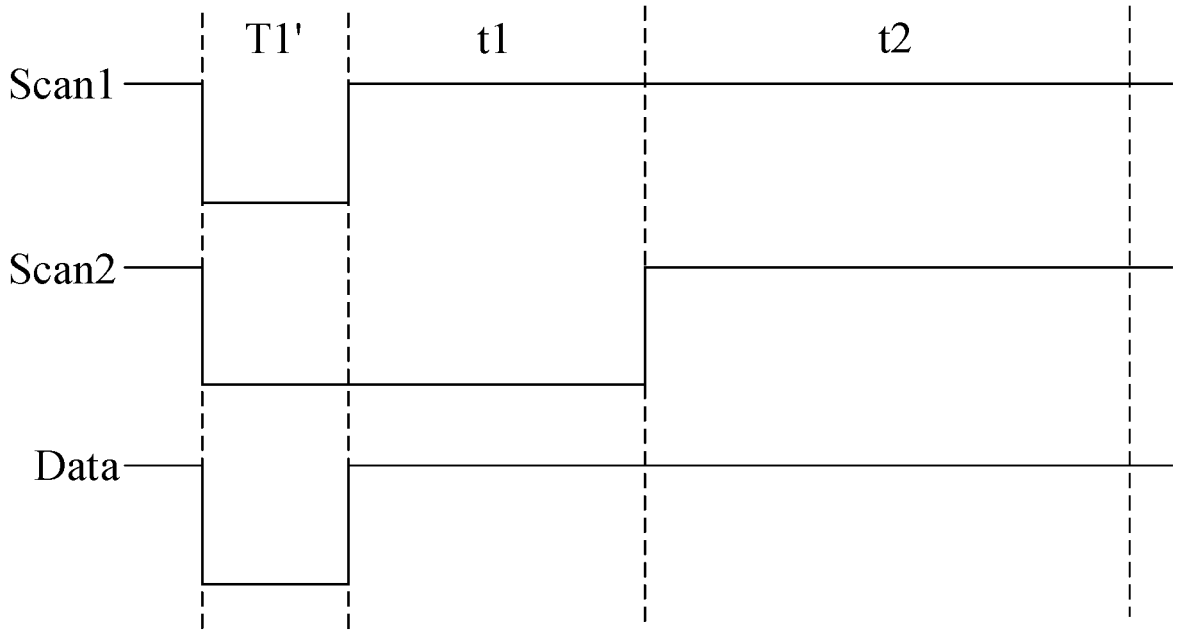
FIG. 8 is a schematic diagram II of a working time sequence of the display panel corresponding to FIG. 3.

The circuit structure shown in FIG. 3 is taken for example. FIG. 7 and FIG. 8 are corresponding circuit time sequence diagrams.

At the reset and compensation stage T'1, as shown in FIG. 7 and FIG. 8, signals of the first scanning control end Scan1 and the second scanning control end Scan2 are both low-level signals, and the first switch transistor T1, the second switch transistor T2, the third switch transistor T3 and the driving transistor DT are all in a turned-on state. If the anode voltage (the voltage at the point o) of the light emitting device 200 is 2 V during displaying of a previous frame, and the anode voltage of the current frame is 3 V, the voltage of the data voltage end Data is 3 V; and at this time, the voltage at the point o is less than the voltage of the data voltage end Data, and the second output end Out2 of the comparator OP1 outputs a low-level working voltage; at this time, the second capacitor C2 is discharged, so that the gate voltage (a voltage at a point g) of the driving transistor DT is decreased, the divided voltage of the driving transistor DT is reduced, and the anode voltage (the voltage at the point o) is increased; and the charging for the first capacitor C1 is ended until the voltage at the point o is consistent with the voltage of the data voltage end Data to reach a balanced state.

At the light emitting stage T'2: when the light emitting gray scale is greater, as shown in FIG. 7, the signal of the first scanning control end Scan1 is a high-level signal, and the signal of the second scanning control end Scan2 is a low-level signal; the first switch transistor T1 and the second switch transistor T2 are in a turned-off state; and the third switch transistor T3 is in a turned-on state. Due to the bootstrap action of the first capacitor C1, the driving transistor DT is still in the turned-on state, and the voltage of the data voltage end Data is normally input for displaying. When the light emitting gray scale is less, as shown in FIG. 8, since the anode voltage at the low gray scale is lower, the divided voltage of the driving transistor DT is higher; an at this time, the power consumption consumed by the driving transistor DT is higher. In order to improve this phenomenon, the voltage at the point o can be increased to reduce the divided voltage of the driving transistor DT, that is, the voltage of the data voltage end Data is increased to increase the voltage at the point o. In order to achieve the same light emitting effect at the low gray scale, the turn-on time of the pixel circuit in one frame can be shortened, that is, the duty ratio of the third switch transistor T3 is reduced. In FIG. 8, at the stage T'2, the turn-on time of the third switch transistor T3 is t1, and the third switch transistor T3 is turned off within a time period t2, so that the turn-on time of the third switch transistor T3 when the voltage at o is not adjusted is t1+t2, thereby reducing the static power consumption of the pixel circuit.

Therefore, in embodiments of the present disclosure, the external compensation circuits are added to cause the driving transistors to work in the linear region to reduce the power consumption. In addition, during displaying at the low gray scale, the anode voltage is increased, and the turn-on time of the third switch transistor is shortened, so that the power consumption can be further reduced. Furthermore, the pixel circuit of the present disclosure does not need threshold compensation, and only includes four transistors. Compared with the 7T1C structure in the related art, this structure can reduce the dynamic consumption of the pixel circuit, so that the present disclosure can reduce the power consumption of the display panel.

The display panel provided in embodiments of the present disclosure may be an electroluminescence display panel such as an OLED display panel, a micro LED display panel, or a mini LED display panel.

Based on the same inventive concept, the embodiments of the present disclosure further provide a display apparatus, including the above-mentioned display panel provided in the embodiments of the present disclosure. The display apparatus may be: any product or component having a display function, such as a mobile phone, a tablet computer, a television, a display, a notebook computer, a digital photo frame and a navigator. Other indispensable components of the display apparatus are all understood by those skilled in the art, and are not described herein and should not be construed as limiting the present disclosure. The implementation of the display apparatus may refer to the embodiment of the foregoing display panel, and repeated descriptions are omitted.

According to the display panel and the driving method thereof, and the display apparatus provided in embodiments of the present disclosure, the display region and the non-display region surrounding the display region are included. The display region includes the plurality of pixel regions in an array distribution; the pixel regions include the pixel circuits and the light emitting devices; and the non-display region includes the external compensation circuits. Each column of pixel circuits is electrically connected to the same external compensation circuit, and different columns of pixel circuits are electrically connected to different external compensation circuits. The pixel circuits include the driving transistors electrically connected to the light emitting devices. The first positive input end of each external compensation circuit is electrically connected to the anodes of all the corresponding light emitting devices; the first negative input end of each external compensation circuit is electrically connected to the data voltage end; and the first output end of each external compensation circuit is electrically connected to the gates of all the corresponding driving transistors. The external compensation circuits are configured to adjust the anode voltages of the light emitting devices to cause the anode voltages of the light emitting devices to be consistent with the voltages of the data voltage ends and to cause the driving transistors to work in a linear region. In the present disclosure, the external compensation circuits electrically connected to the pixel circuits are added. Since the external compensation circuits are configured to adjust the anode voltages of the light emitting devices to cause the anode voltages of the light emitting devices to be consistent with the voltages of the data voltage ends, the threshold voltages of the driving transistors do not need to be compensated. Therefore, the driving transistors can work in the linear region. When the light emitting devices emit light with the same brightness, the divided voltages of the driving transistors in the present disclosure are greatly reduced, thus reducing the power consumption of the pixel circuits.

Obviously, those skilled in the art can make various changes and modifications to the present disclosure without departing from the spirit and scope of the present disclosure. Therefore, if these changes and modifications of the present disclosure fall within the scope of the claims of the present disclosure and equivalent technologies of the present disclosure, the present disclosure is intended to include these changes and modifications.

What is claimed is:

1. A display panel, comprising a display region and a non-display region surrounding the display region, wherein the display region comprises a plurality of pixel regions in an array distribution; each of the pixel regions comprises a pixel circuit and a light emitting device; the non-display region comprises an external compensation circuit; each column of pixel circuits is electrically connected to a same external compensation circuit, and different columns of pixel circuits are electrically connected to different external compensation circuits;

the pixel circuit comprises a driving transistor electrically connected to the light emitting device;

a first positive input end of the external compensation circuit is electrically connected to anodes of all light emitting devices; a first negative input end of the external compensation circuit is electrically connected to a data voltage end; a first output end of the external compensation circuit is electrically connected to gates of all driving transistors;

the external compensation circuit is configured to adjust an anode voltage of the light emitting device to cause the anode voltage of the light emitting device to be consistent with a voltage of the data voltage end and to cause the driving transistor to work in a linear region.

2. The display panel according to claim 1, wherein the pixel circuit further comprises: a first switch transistor, a second switch transistor, a third switch transistor and a first capacitor;

both a gate of the first switch transistor and a gate of the second switch transistor are electrically connected to a first scanning control end; a first electrode of the first switch transistor is electrically connected to the first output end; a second electrode of the first switch transistor is electrically connected to the gate of the driving transistor;

a first electrode of the second switch transistor is electrically connected to the first positive input end, and a second electrode of the second switch transistor is electrically connected to the anode of the light emitting device;

a first electrode of the driving transistor is electrically connected to a first electrode of the third switch transistor, and a second electrode of the driving transistor is electrically connected to the anode of the light emitting device;

a gate of the third switch transistor is electrically connected to a second scanning control end, and a second electrode of the third switch transistor is electrically connected to a first power end;

the first capacitor is electrically connected between the gate of the driving transistor and the first power end;

a cathode of the light emitting device is grounded.

3. The display panel according to claim 2, wherein the external compensation circuit comprises: a comparison circuit and a feedback circuit;

the comparison circuit is configured to output a working voltage according to the anode voltage of the light emitting device and the voltage of the data voltage end;

the feedback circuit is configured to control, according to the working voltage, the first capacitor to be charged and discharged to cause the anode voltage of the light emitting device to be consistent with the voltage of the data voltage end.

4. The display panel according to claim 3, wherein the comparison circuit comprises a comparator; the comparator has the first positive input end, the first negative input end and a second output end; and the second output end is electrically connected to the feedback circuit.

5. The display panel according to claim 4, wherein the feedback circuit comprises:

an amplifier, a first resistor, a second resistor and a second capacitor;

the amplifier has a second positive input end, a second negative input end and the first output end; the second positive input end is electrically connected to a first end of the first resistor; a second end of the first resistor is grounded;

the second negative input end is electrically connected to a first end of the second resistor; a second end of the second resistor is electrically connected to the second output end;

the second capacitor is electrically connected between the second negative input end and the first output end.

6. The display panel according to claim 5, wherein a product of resistance times capacitance, (RC) between the first output end and the gate of the driving transistor is identical to a product of RC between the first positive input end and the anode of the light emitting device.

7. The display panel according to claim 4, wherein the comparison circuit further comprises a third resistor; and the third resistor is electrically connected between the first negative input end and the first positive input end.

8. The display panel according to claim 2, wherein the driving transistor and all the switch transistors are P-type transistors or N-type transistors.

9. A method for driving the display panel according to claim 2, comprising:

enabling the driving transistors to work in the linear region, and adjusting, by the external compensation circuit, the anode voltage of the light emitting device to cause the anode voltage of the light emitting device to be consistent with a voltage of the data voltage end at a reset and compensation stage; and driving, by the pixel circuit, the light emitting device to emit light at a light emitting stage.

10. The driving method according to claim 9, wherein at the light emitting stage, in response to that a light emitting gray scale of the light emitting device is a preset gray scale, increasing the voltage of the data voltage end to increase the anode voltage of the light emitting device and reducing a duty ratio of the third switch transistor.

11. A display apparatus, comprising a display panel, wherein the display panel comprises a display region and a non-display region surrounding the display region; the display region comprises a plurality of pixel regions in an array distribution; each of the pixel regions comprises a pixel circuit and a light emitting device; and the non-display region comprises an external compensation circuit; each column of pixel circuits is electrically connected to a same external compensation circuit, and different columns of pixel circuits are electrically connected to different external compensation circuits;

the pixel circuit comprises a driving transistor electrically connected to the light emitting device;

a first positive input end of the external compensation circuit is electrically connected to anodes of all light emitting devices; a first negative input end of the external compensation circuit is electrically connected to a data voltage end; a first output end of the external compensation circuit is electrically connected to gates of all driving transistors;

the external compensation circuit is configured to adjust an anode voltage of the light emitting device to cause the anode voltage of the light emitting device to be consistent with a voltage of the data voltage end and to cause the driving transistor to work in a linear region.

12. The display apparatus according to claim 11, wherein the pixel circuit further comprises: a first switch transistor, a second switch transistor, a third switch transistor and a first capacitor;

both a gate of the first switch transistor and a gate of the second switch transistor are electrically connected to a first scanning control end; a first electrode of the first switch transistor is electrically connected to the first output end; a second electrode of the first switch transistor is electrically connected to the gate of the driving transistor;

a first electrode of the second switch transistor is electrically connected to the first positive input end, and a second electrode of the second switch transistor is electrically connected to the anode of the light emitting device;

a first electrode of the driving transistor is electrically connected to a first electrode of the third switch transistor, and a second electrode of the driving transistor is electrically connected to the anode of the light emitting device;

a gate of the third switch transistor is electrically connected to a second scanning control end, and a second electrode of the third switch transistor is electrically connected to a first power end;

the first capacitor is electrically connected between the gate of the driving transistor and the first power end;

a cathode of the light emitting device is grounded.

13. The display apparatus according to claim 12, wherein the external compensation circuit comprises: a comparison circuit and a feedback circuit;

the comparison circuit is configured to output a working voltage according to the anode voltage of the light emitting device and the voltage of the data voltage end;

the feedback circuit is configured to control, according to the working voltage, the first capacitor to be charged and discharged to cause the anode voltage of the light emitting device to be consistent with the voltage of the data voltage end.

14. The display apparatus according to claim 13, wherein the comparison circuit comprises a comparator; the comparator has the first positive input end, the first negative input end and a second output end; and the second output end is electrically connected to the feedback circuit.

15. The display panel according to claim 14, wherein the feedback circuit comprises: an amplifier, a first resistor, a second resistor and a second capacitor;

the amplifier has a second positive input end, a second negative input end and the first output end; the second positive input end is electrically connected to a first end of the first resistor; a second end of the first resistor is grounded;

the second negative input end is electrically connected to a first end of the second resistor; a second end of the second resistor is electrically connected to the second output end;

the second capacitor is electrically connected between the second negative input end and the first output end.

16. The display apparatus according to claim 15, wherein a product of resistance times capacitance, (RC) between the first output end and the gate of the driving transistor is identical to a product of RC between the first positive input end and the anode of the light emitting device.

17. The display apparatus according to claim 14, wherein the comparison circuit further comprises a third resistor; and the third resistor is electrically connected between the first negative input end and the first positive input end.

18. The display apparatus according to claim 13, wherein the driving transistor and all the switch transistors are P-type transistors or N-type transistors.

* * * * *